US009640899B2

(12) United States Patent
Kim et al.

(10) Patent No.: US 9,640,899 B2
(45) Date of Patent: May 2, 2017

(54) WATERPROOF ELECTRICAL RECEPTACLE ASSEMBLY

(71) Applicant: Tyco Electronics AMP Korea Ltd., Kyunsangbuk-do (KR)

(72) Inventors: Jung-Hoon Kim, Kyungsangbuk-do (KR); Hye-Jun Lee, Kyungsangbuk-do (KR); Yong-Jun Cho, Kyungsangbuk-do (KR)

(73) Assignee: Tyco Electronics AMG Korea Ltd., Kyungsangduk-Do (KR)

( * ) Notice: Subject to any disclaimer, the term of this patent is extended or adjusted under 35 U.S.C. 154(b) by 0 days.

(21) Appl. No.: 14/625,799

(22) Filed: Feb. 19, 2015

(65) Prior Publication Data

US 2015/0236441 A1 Aug. 20, 2015

(30) Foreign Application Priority Data

Feb. 20, 2014 (KR) ..... 10-2014-0019379
May 30, 2014 (KR) ..... 10-2014-0066273

(51) Int. Cl.
*H01R 13/40* (2006.01)
*H01R 13/52* (2006.01)
*H01R 24/76* (2011.01)

(52) U.S. Cl.
CPC ..... *H01R 13/521* (2013.01); *H01R 24/76* (2013.01)

(58) Field of Classification Search
CPC ..... H01R 13/521; H01R 24/76
USPC ... 439/587, 589, 660, 607.4, 607.35, 607.36
See application file for complete search history.

(56) References Cited

U.S. PATENT DOCUMENTS 6,398,587 B1 * 6/2002 Chen ..... H01R 12/7023 439/573
6,623,299 B1 * 9/2003 Liu ..... H01R 13/5845 439/587
7,731,535 B1 * 6/2010 Wan ..... H01R 12/712 439/541.5
8,052,467 B1 * 11/2011 Xie ..... H01R 13/5219 439/589
8,257,111 B1 * 9/2012 Smutny ..... H01R 13/5208 439/511
8,277,253 B2 * 10/2012 Lee ..... H01R 12/724 439/540.1
8,696,383 B2 * 4/2014 Do ..... H01R 13/6581 439/607.35
8,939,777 B2 * 1/2015 Lin ..... H01R 13/6581 439/607.4
2001/0023149 A1 * 9/2001 Murayama ..... H01R 13/521 439/587
2002/0052140 A1 * 5/2002 Hara ..... H01R 13/521 439/587

(Continued)

*Primary Examiner* — Abdullah Riyami
*Assistant Examiner* — Nelson R Burgos-Guntin
(74) *Attorney, Agent, or Firm* — Barley Snyder

(57) ABSTRACT

A receptacle assembly is disclosed having a plurality of contact pins, a contact aligning block, a block receiving body, a housing, and a retaining plate. The contact aligning block is formed to retain the contact pins, and into which a portion of the contact pins is inserted. The block receiving body is overmolded to cover the contact aligning block. The block receiving body is positioned in the housing. The retaining plate is positioned against the block receiving body, applying a force against the block receiving body, and compressively holding and retaining the block receiving body in the housing.

17 Claims, 7 Drawing Sheets

(56) References Cited

U.S. PATENT DOCUMENTS

| | | | | |
|---|---|---|---|---|
| 2005/0101185 | A1* | 5/2005 | Gensert | B60K 15/03 439/587 |
| 2005/0159046 | A1* | 7/2005 | Drescher | H01R 13/5205 439/587 |
| 2007/0141904 | A1* | 6/2007 | Hayashi | H01R 13/5208 439/587 |
| 2007/0232140 | A1* | 10/2007 | Tyler | H01R 13/506 439/587 |
| 2008/0299831 | A1* | 12/2008 | Kim | H01R 13/6278 439/638 |
| 2010/0009570 | A1* | 1/2010 | Abramov | H01R 13/5202 439/587 |
| 2011/0104943 | A1* | 5/2011 | Suzuki | H01R 13/504 439/587 |
| 2011/0294345 | A1* | 12/2011 | Peng | H01R 13/5202 439/589 |
| 2012/0231661 | A1* | 9/2012 | Song | H01R 23/6873 439/607.4 |
| 2013/0344736 | A1* | 12/2013 | Latunski | H01R 13/521 439/587 |
| 2015/0180159 | A1* | 6/2015 | Endo | H01R 13/516 439/587 |
| 2015/0236441 | A1* | 8/2015 | Kim | H01R 24/76 439/587 |
| 2015/0244099 | A1* | 8/2015 | Lee | H01R 13/508 439/660 |
| 2015/0255911 | A1* | 9/2015 | Kato | H01R 24/64 439/345 |
| 2015/0340798 | A1* | 11/2015 | Kao | H01R 13/516 439/660 |
| 2016/0020548 | A1* | 1/2016 | Takamura | H01R 13/5202 439/587 |

* cited by examiner

WATERPROOF ELECTRICAL RECEPTACLE ASSEMBLY

CROSS-REFERENCE TO RELATED APPLICATIONS

This application claims the benefit of the filing date under 35 U.S.C. §119(a)-(d) of Korean Patent Application No. 10-2014-0019379, filed Feb. 20, 2014, and Korean Patent Application No. 10-2014-0066273, filed May 30, 2014.

FIELD OF THE INVENTION

The present invention is generally related to an electrical receptacle assembly, and more specifically, to a waterproof electrical receptacle.

BACKGROUND

A conventional mobile communication terminal has a video call function, a function of inputting and outputting information, and a data storage function, as well as a voice call function. A variety of audio and visual content is often applied through the mobile communication terminal, due to diversification of functions available through the mobile communication terminal. Accordingly, the mobile communication terminal may perform complex functions, for example, capturing a photo or video, playing a music file or a video file, playing games, receiving broadcasting, and the like. Additionally, the terminal also may perform functions such as that of a storage medium to store personal information or charge a credit card, as well as performing a call function. The above functions are collectively included and accordingly, a multimedia device is implemented.

When the mobile communication terminal has various additional functions as described above, an electrical connector for an input and output of data and a connection to a peripheral device are required. The connector may include a universal serial bus (USB) port through which a user may transmit data of the mobile communication terminal on demand, or an input/output (I/O) port to interface with a peripheral device, such as earphones, a remote controller, a television, and the like.

Connectors used in vehicles and other similar applications may include sealing members to prevent penetration by water therein. Conventional sealing members are formed of an elastic material, such as rubber. When two complimentary connectors are coupled to each other, the conventional sealing member are interposed between the connectors, being deformed and compressed, to prevent water from entering from the outside and to maintain air tightness of a portion in which the connectors are coupled to each other.

However, the conventional sealing members have several disadvantages. For example, a gap between a sealing member and an inner side of the connector is formed due to a space caused by a contraction of a connector forming mold, an incorrect tolerance occurring in manufacturing of existing connectors, and the like. Accordingly, it is difficult to stably maintain a state in which the sealing member is compressed, and a waterproof efficiency are reduced. Additionally, in applications having a wide range of temperatures, a space is formed between a metal portion and a mold based on a difference in physical properties between the metal portion and the mold. Again, due to the space, it is difficult to ensure waterproof properties.

Accordingly, there is a need for a waterproof electrical connector that maintains its waterproofing function even in the presence of the contraction of the connector forming mold, incorrect tolerances, and exposure to wide ranges of temperatures.

SUMMARY

A receptacle assembly has a plurality of contact pins a contact aligning block, a block receiving body, a housing, and a retaining plate. The contact aligning block is formed to retain the contact pins, and into which a portion of the contact pins is inserted. The block receiving body is overmolded to cover the contact aligning block. The block receiving body is positioned in the housing. The retaining plate is positioned against a terminating end of the block receiving body, applying an inward force against the block receiving body, and compressively holding and retaining the block receiving body in the housing.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
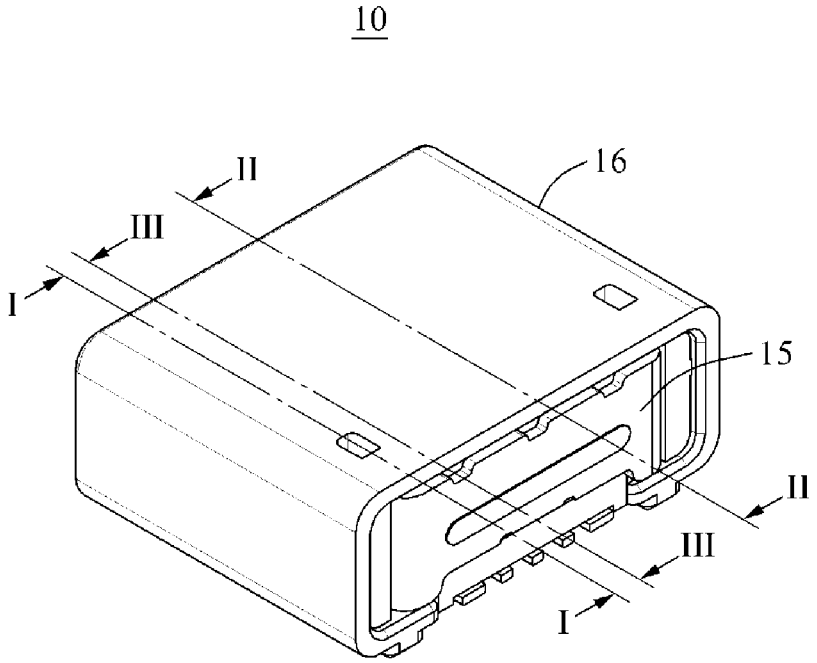
FIG. 1 is a perspective diagram of a receptacle assembly.

In the following description, the same elements will be designated by the same reference numerals although they are shown in different drawings. A detailed description of known functions and configurations incorporated herein will be omitted when it may make the subject matter of the present invention unclear.

Further, to describe elements according to embodiments of the present invention, the terms first, second, A, B, (a), (b), etc. are used herein. These terms are merely used to distinguish one element from another, not to imply or suggest the substances, order, number of, or sequence of the elements. It will be understood that when an element is described as being "connected," "coupled," or "linked" to another element, it can be directly connected or coupled to the other element, or intervening elements are present unless otherwise indicated.

A receptacle assembly 10, according to an embodiment of the present invention as illustrated in FIG. 1-6, will be further described.

In the following description, a portion of the receptacle assembly 10 connected to a complimentary mating connector 20 is referred to as a "mating end" and an opposite portion to the mating end is referred to as a "terminating end".

The receptacle assembly 10 has a plurality of contact pins 11, a contact aligning block 12, a block receiving body 13, a retaining plate 15, and a housing 16.

The contact pins 11 are positioned in the receptacle assembly 10, based on a predetermined standard. For example, the contact pins 11 are arranged based on a universal serial bus (USB) standard, such as a USB 2.0 standard or a USB 3.0 standard. The contact pins 11 are arranged in a row, as shown in an embodiment of FIG. 1, however, there is no limitation thereto. In an embodiment (not shown), different types of pins, including a USB pin and an input/output (I/O) pin, are vertically arranged in two rows. Additionally, in other embodiments, the contact pins 11 are arranged in various other configurations.

A portion of the contact pins 11 are inserted into the contact aligning block 12, and retained therein. The contact aligning block 12 is formed on a path through which water flows along the contact pins 11, and may function to prevent water inflow.

The contact pins 11 are formed of metallic materials or other similar metallic materials, and the block receiving body 13 is formed of a resin material, such as plastic. When exposed to a range of temperatures, a gap form between the contact pins 11 and the block receiving body 13, due to a difference in physical properties (for example, a contraction percentage) between the contact pins 11 and the block receiving body 13. Additionally, water may flow into the receptacle assembly 10 through the formed gap.

In an embodiment of the present invention, the contact aligning block 12 effectively prevents water from flowing into the receptacle assembly 10, by preventing a gap from being formed between the contact pins 11 and the contact aligning block 12. In other words, a waterproof function may be maintained by preventing a gap from being formed between the contact pins 11, the contact aligning block 12 and the block receiving body 13, despite changes in temperature.

To prevent a gap from being formed, the contact aligning block 12 is formed of the same material, or a material of the same type, as the block receiving body 13. For example, the contact aligning block 12 may be formed of polybutylene terephthalate (PBT)-based materials, polyamide (PA)-based materials, or adhesive materials. Similarly, the block receiving body 13 may also be formed of PBT-based materials and PA-based materials. However, there is no limitation thereto, and accordingly; the contact aligning block 12 may be substantially formed of various materials allowing sealing of the receptacle assembly 10.

The block receiving body 13 is overmolded to cover the contact aligning block 12. Additionally, the block receiving body 13 is formed to cover the contact pins 11.

Figure 2:
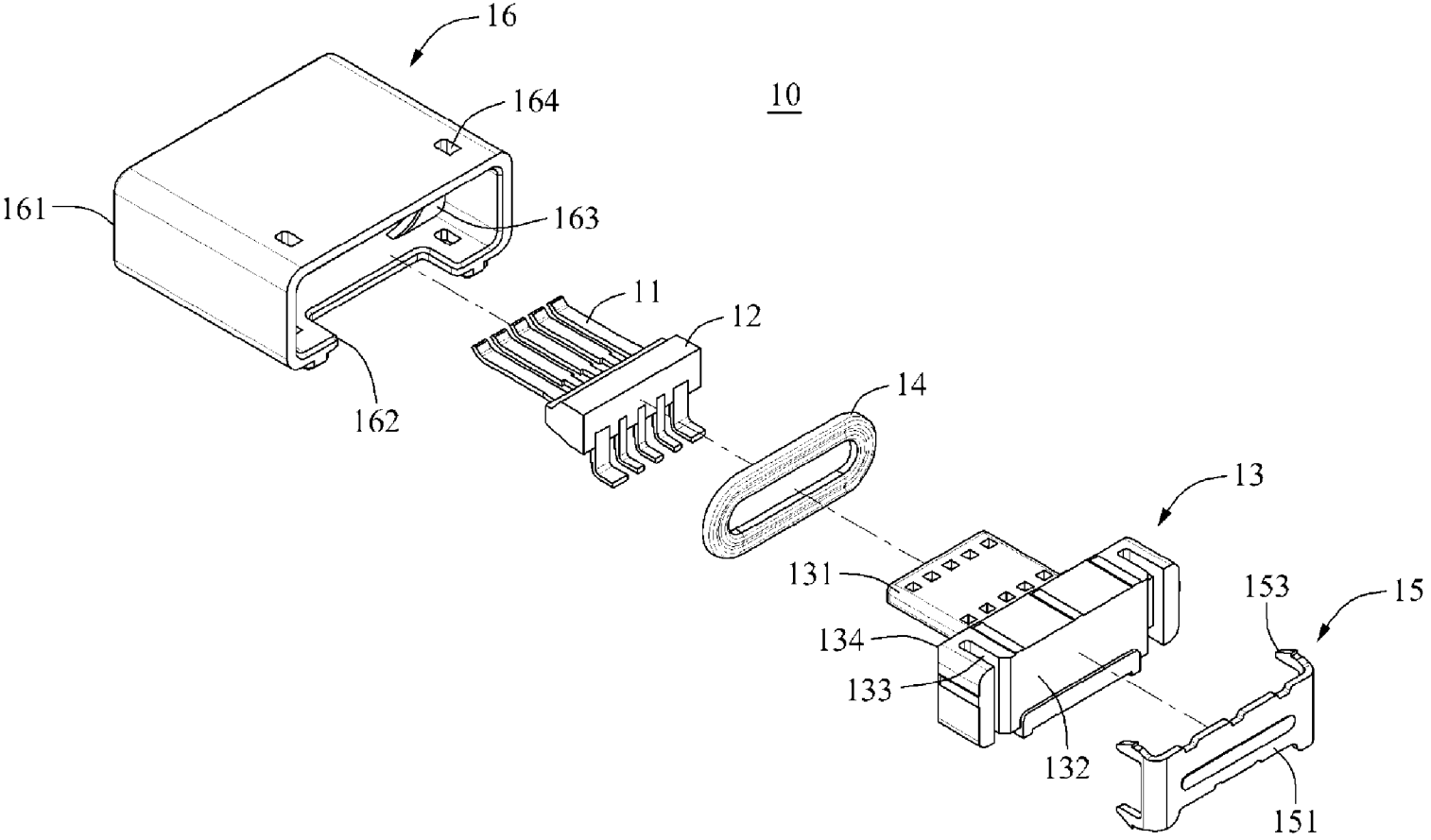
FIG. 2 is an exploded perspective diagram of the receptacle assembly.
Figure 3:
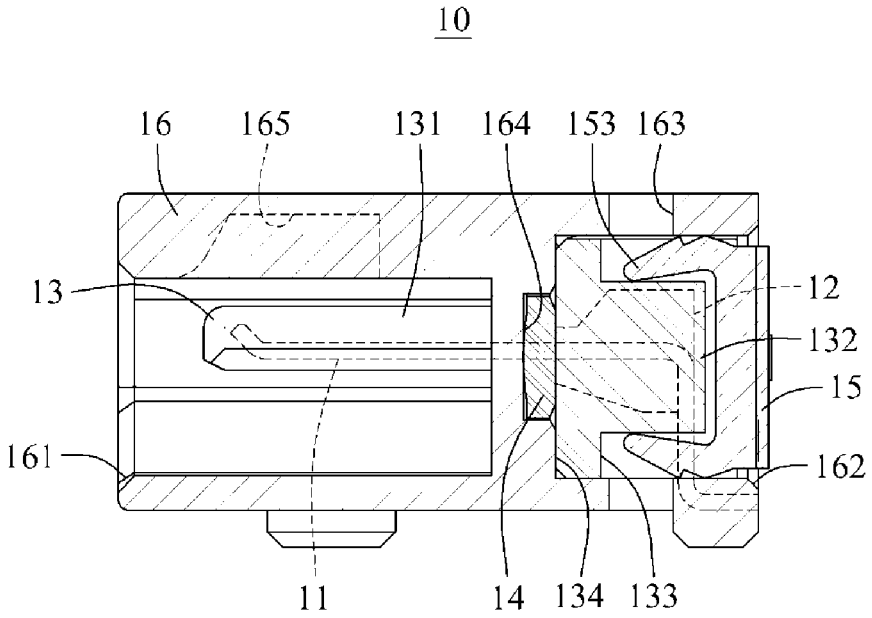
FIGS. 3 and 4 are cross-sectional diagrams, of the receptacle assembly having a retaining plate, taken along a line I-I of FIG. 1.
Figure 4:
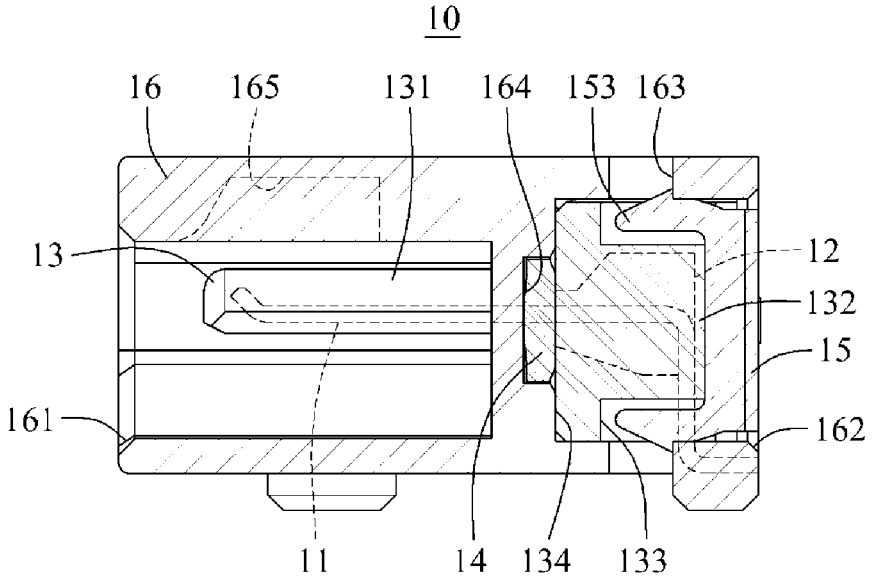
Figure 5:
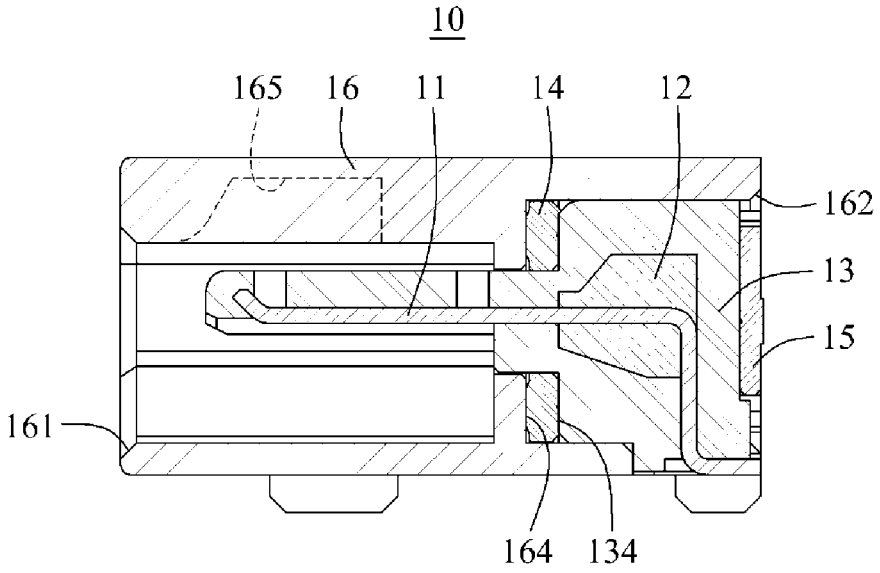
FIG. 5 is a cross-sectional diagram of the receptacle assembly, taken along a line II-II of FIG. 1.

In an embodiment of FIG. 2, a contact pin support 131 houses and supports the contact pins 11. In an embodiment, the contact pin support 131 is integrally connected to block receiving body 13, protruding outward therefrom.

a. The housing 16 receives the block receiving body 13 and the contact pins 11, to form an external appearance of the receptacle assembly 10. In an embodiment, the housing 16 is formed by metal injection molding (MIM). By using the MIM, the housing 16 may have various shapes, and may be formed as a single seamless object. Accordingly, it is possible to prevent water from flowing into the receptacle connector 10 through the housing 16.

On a mating end of the housing 16, a mating connector receiving opening 161, shown in the embodiments of FIGS. 3-7, and a mating connector receiving space (not labeled) are formed so that a mating connector 20, as shown most clearly in FIGS. 3-6, may be coupled to the receptacle assembly 10. On an inner surface of the housing 16, a locking arm receiving space 165, shown in FIG. 7, by which a cantilevered locking arm (see FIG. 7) of the mating connector 20 is received, may be formed. For example, the locking arm receiving space 165 may be recessed by a predetermined depth in a predetermined location in the inner surface of the housing 16, such that a complimentary locking projection positioned at free end of the cantilevered locking arm may be inserted to lock the mating connector 20 to the receptacle assembly 10.

In an embodiment of FIG. 2, a contact receiving opening 162 is formed on a terminating end of the housing 16, opposite to the mating connector receiving opening 161 formed on the mating end.

In the embodiments of FIGS. 2-5, the receptacle assembly 10 includes a sealing member 14 to enhance a waterproof performance. The sealing member 14 is disposed and compressed between the block receiving body 13 and the housing 16. Additionally, the sealing member 14 may positioned on an outer side of the block receiving body 13. In an embodiment, the sealing member 14 is formed in a shape of a ring having a predetermined thickness. The sealing member 14 is formed of a compressible material with a predetermined elasticity, such as rubber or silicone.

To mount and compress the sealing member 14, a first stepped portion 134 is formed in one side of the block receiving body 13, and a complimentary second stepped portion 164 is formed in a location corresponding to the first stepped portion 134 in the inner surface of the housing 16. The second stepped portion 164 engages with the first stepped portion 134 when the block receiving body 13 is positioned in the housing 16, and the sealing member 14 is positioned therebetween, being compressed between the first stepped portion 134 and the second stepped portion 164. One of ordinary skill in the art would appreciate that there is no limitation thereto by the drawings, such as a location and a shape of each of the first stepped portion 134 and the second stepped portion 164, with such locations and shapes being permitted to be substantially changed.

The retaining plate 15 fixes and retains the inserted block receiving body 13 in the housing 16. In an embodiment, the retaining plate 15 is formed of a metallic material, or a material having a predetermined elasticity and rigidity.

The retaining plate 15 is positioned in the contact receiving opening 162 abutting against a terminating end of the inserted block receiving body 13. The retaining plate 15 is fastened to the housing 16 such that the retaining plate 15 applies an inward force against the terminating end of the block receiving body 13, to hold and retain the block receiving body 13 in the housing 16. Additionally, when the retaining plate 15 applies the inward force against the block receiving body 13, the sealing member 14 is compressed between the housing 16 and the block receiving body 13, to seal a gap between the housing 16 and the block receiving body 13. In an embodiment, the retaining plate 15 is approximately U-shaped. The retaining plate 15 has a retaining plate body 151 and a pair of retaining plate fastening ends 153. The retaining plate body 151 may correspond to a shape of a rear surface of the terminating end of the block receiving body 13. The retaining plate fastening ends 153 are formed on opposite ends of the retaining plate body 151, to engage and lock the retaining plate to the housing 16, protruding outward in the same direction, substantially orthogonal to the retaining plate body 151. The retaining plate fastening ends 153 may be formed in a shape of a hook or a cantilevered locking arm.

The block receiving body 13 has a retaining plate mounting portion 133 on the terminal end, onto which the retaining plate 15 is mounted. In an embodiment, the retaining plate mounting portion 133 is recessed by a predetermined depth in a terminating end 132 of the block receiving body 13, and may have a shape corresponding to a shape of the retaining plate 15. Additionally, because the retaining plate fastening ends 153 protrude outward toward the mating end from the retaining plate 15, the retaining plate mounting portion 133 includes fastening end receiving grooves (not labeled) formed to house the retaining plate fastening ends 153. The fastening end receiving grooves have a width wherein a portion of the retaining plate fastening ends 153 are received in the fastening end receiving grooves, and an edge of the retaining plate fastening ends 153 is exposed so that the retaining plate fastening ends 153 may engage and be coupled to the housing 16. However, one of ordinary skill in the art would appreciate that the embodiments shown in the Figures are not limiting, and that the shape of the retaining plate mounting portion 133 may have other shapes without departing from the spirit and principle of the invention.

The housing 16 has a complimentary fastening end receiving member 163 to which the retaining plate fastening ends 153 is engaged and fastened. The fastening end receiving member 163 is formed in at least one location in an inner side of the housing 16. In an embodiment, the fastening end receiving member 163 is formed on an upper inner surface and a lower inner surface of the housing 16. In an embodiment, the fastening end receiving member 163 is a fastening end receiving hole extending through the housing 16. In an embodiment, the fastening end receiving member 163 is a groove recessed into the inner surface of the housing 16. However, one of ordinary skill in the art would appreciate that the embodiments shown in the Figures are not limiting, and that the shape and a location of the fastening end receiving member 163 may have other shapes or locations without departing from the spirit and principle of the invention.

The retaining plate 15 exerts an inward force and is fastened to the terminating end of the block receiving body 13 and, accordingly, compresses the sealing member 14 in a stable manner. In addition, the retaining plate 15 effectively fixes the inserted block receiving body 13 in the housing 16. Because the retaining plate 15 is included, it is possible to fix the contact aligning block 12 and the block receiving body 13 to the housing 16, instead of performing an additional assembling process, thus allowing a product to be miniaturized.

Figure 6:
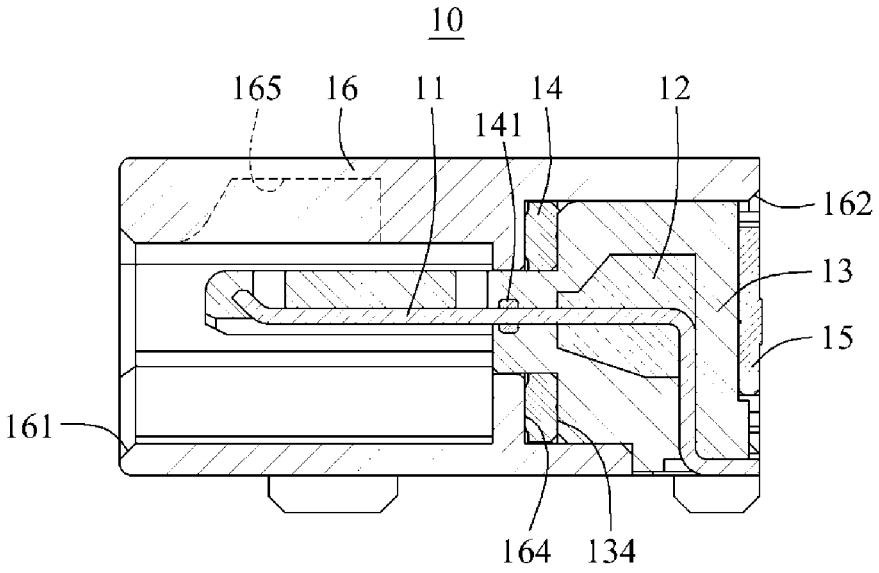
FIG. 6 is a cross-sectional diagram of the receptacle assembly having an auxiliary sealing member, taken along the line II-II.
Figure 7:
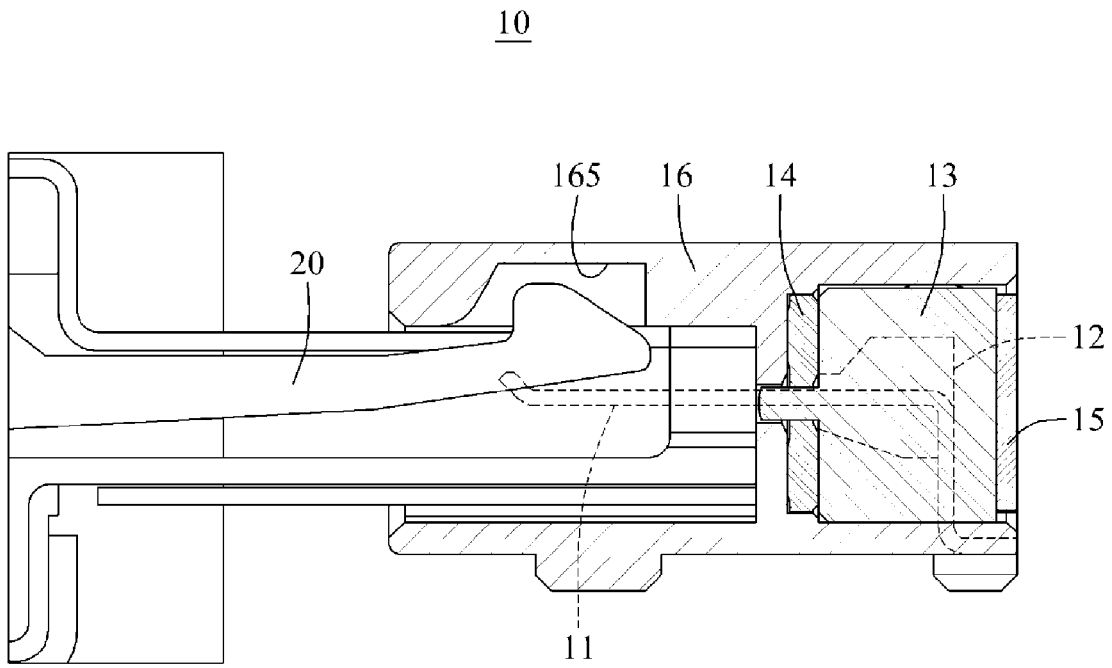
FIG. 7 is a cross-sectional diagram of the receptacle assembly, taken along a line III-III of FIG. 1.

In an embodiment of FIG. 6, to enhance a waterproof efficiency of the receptacle assembly 10, the receptacle assembly 10 further includes an auxiliary sealing member 141. The auxiliary sealing member 141 is positioned on the contact pin 11, proximate to a terminating end, and the block receiving body 13 covers the auxiliary sealing member 141. In an embodiment, the auxiliary sealing member 141 is disposed on the path through which water flows along the contact pins 11 into the housing 16. The auxiliary sealing member 141 may be positioned in front of the contact aligning block 12 and the sealing member 14, proximate to the mating end. In an embodiment, the auxiliary sealing member 141 is formed in a shape of a ring, and may formed of a rubber or silicone material, or other similar sealing materials.

However, one of ordinary skill in the art would appreciate that the embodiments shown in the Figures are not limiting, and that the shape and location of the auxiliary sealing member 141 may have other shapes or locations without departing from the spirit and principle of the invention.

Various embodiments of the present invention may include at least one of the following effects:

According to embodiments of the present invention, it is possible to stably maintain a state in which a sealing member is compressed, and to efficiently fix a mold. In addition, it is possible to fix the mold to a housing, instead of performing an additional assembling process, and to miniaturize a product. Furthermore, it is possible to maintain a waterproof function, despite a change in a temperature condition. Moreover, a waterproof structure may be formed using a reduced number of assembly steps, thus reducing manufacturing costs.

A number of exemplary embodiments have been described above. However, one of ordinary skill in the art would appreciate that various modifications may be made. For example, suitable results are achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A receptacle assembly, comprising:
- a plurality of contact pins;
- an auxiliary sealing member positioned on the contact pins;
- a contact aligning block in which portions of the contact pins are inserted;
- a block receiving body covering the contact aligning block;
- a housing in which the block receiving body is positioned; and
- a retaining plate positioned against the block receiving body, applying an inward force against the block receiving body, and compressively holding and retaining the block receiving body in the housing.

2. The receptacle assembly of claim 1, wherein the contact aligning block blocks a path through which water tends to flow along the contact pins.

3. The receptacle assembly of claim 1, wherein the contact aligning block and the block receiving body are formed of the same materials or similar types of materials.

4. The receptacle assembly of claim 1, wherein the retaining plate has a retaining plate fastening end protruding outward substantially orthogonal from the retaining plate in a direction in which the block receiving body is held and retained in the housing.

5. The receptacle assembly of claim 4, wherein
- (a) the housing has one fastening end receiving member in an upper inner surface, and one fastening end receiving member in a lower inner surface, and
- (b) the retaining plate fastening end is engaged with at least one fastening end receiving members.

6. The receptacle assembly of claim 4, wherein the retaining plate is formed of elastic metallic materials.

7. The receptacle assembly of claim 1, wherein the housing is metal injection molded.

8. The receptacle assembly of claim 7, wherein a locking arm receiving space is positioned on an inner surface of the housing.

9. The receptacle assembly of claim 1, further comprising a sealing member disposed and compressed between the block receiving body and the housing to seal a gap between the block receiving body and the housing.

10. The receptacle assembly of claim 9, wherein the sealing member is positioned between the block receiving body and an inner surface of the housing.

11. The receptacle assembly of claim 10, wherein the block receiving body has a first stepped portion, and the housing has a complementary second stepped portion on the inner surface of the housing.

12. The receptacle assembly of claim 11, wherein the sealing member is positioned between the first stepped portion and the second stepped portion.

13. The receptacle assembly of claim 12, wherein the first stepped portion applies a force in the direction of the second stepped portion such that the sealing member is compressed therebetween.

14. The receptacle assembly of claim 1, wherein (a) the contact aligning block has a mating end; and (b) the auxiliary sealing member is positioned on the mating end of the contact aligning block, on a path through which water tends to flow along the contact pins.

15. The receptacle assembly of claim 14, wherein the block receiving body covers the auxiliary sealing member.

16. The receptacle assembly of claim 11, wherein (a) the sealing member has a mating end; and (b) the auxiliary sealing member is positioned adjacent to the mating end of the sealing member.

17. The receptacle assembly of claim 1, wherein the contact pins are arranged based on a universal serial bus 2.0 standard or a universal serial bus 3.0 standard.

* * * * *